US010493338B2

(12) United States Patent
Abe

(10) Patent No.: US 10,493,338 B2
(45) Date of Patent: Dec. 3, 2019

(54) GOLF CLUB SET

(71) Applicant: Sumitomo Rubber Industries, Ltd., Hyogo (JP)

(72) Inventor: Hiroshi Abe, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/033,780

(22) Filed: Jul. 12, 2018

(65) Prior Publication Data

US 2019/0015716 A1 Jan. 17, 2019

(30) Foreign Application Priority Data

Jul. 13, 2017 (JP) ..... 2017-136692

(51) Int. Cl.
*A63B 53/00* (2015.01)
*A63B 53/04* (2015.01)
*A63B 53/02* (2015.01)

(52) U.S. Cl.
CPC ..... *A63B 53/0475* (2013.01); *A63B 53/02* (2013.01); *A63B 2053/005* (2013.01); *A63B 2053/026* (2013.01); *A63B 2053/042* (2013.01); *A63B 2053/0412* (2013.01); *A63B 2053/0433* (2013.01); *A63B 2053/0491* (2013.01)

(58) Field of Classification Search
USPC ..... 473/287, 290, 291, 350
See application file for complete search history.

(56) References Cited

U.S. PATENT DOCUMENTS 3,059,926 A * 10/1962 Johnstone ..... A63B 53/00 473/291
3,995,857 A * 12/1976 Cochran ..... A63B 53/04 473/291
3,995,858 A * 12/1976 Cochran ..... A63B 53/04 473/291
4,147,349 A * 4/1979 Jeghers ..... A63B 53/04 473/291
4,247,105 A * 1/1981 Jeghers ..... A63B 53/04 473/291
4,715,601 A * 12/1987 Lamanna ..... A63B 53/04 473/291
4,840,380 A * 6/1989 Kajita ..... A63B 53/00 473/291
4,923,197 A * 5/1990 Schacht ..... A63B 53/00 473/291
4,992,236 A * 2/1991 Shira ..... A63B 53/00 419/28

(Continued)

FOREIGN PATENT DOCUMENTS

JP 09239078 A * 9/1997
JP 10127832 A * 5/1998

(Continued)

*Primary Examiner* — Alvin A Hunter
(74) *Attorney, Agent, or Firm* — Studebaker & Brackett PC

(57) ABSTRACT

A golf club set includes golf clubs having different loft angles and including weight-embedded golf clubs. Each of the weight-embedded golf clubs comprises a club head composed of a head main body having a club face for hitting a ball, and an internal weight member disposed in the head main body. The internal weight members of the weight-embedded golf clubs are arranged such that the loft angle is lager, the center of gravity of the internal weight member is positioned more on the toe side.

14 Claims, 17 Drawing Sheets

(56) References Cited

U.S. PATENT DOCUMENTS 5,026,056 A * 6/1991 McNally ..... A63B 53/04 473/291
5,056,788 A * 10/1991 Katayama ..... A63B 53/00 473/291
5,160,137 A * 11/1992 Katayama ..... A63B 53/00 473/291
5,295,686 A * 3/1994 Lundberg ..... A63B 53/00 473/291
5,435,559 A * 7/1995 Swisshelm ..... A63B 53/04 473/291
5,616,086 A * 4/1997 Chappell ..... A63B 53/02 473/290
5,755,624 A * 5/1998 Helmstetter ..... A63B 53/04 473/291
6,077,171 A * 6/2000 Yoneyama ..... A63B 53/04 473/291
7,935,000 B2 * 5/2011 Stites ..... A63B 53/047 473/291
8,262,495 B2 * 9/2012 Stites ..... A63B 53/047 473/226
8,435,132 B2 * 5/2013 Oldknow ..... A63B 53/047 473/291
8,915,794 B2 * 12/2014 Stites ..... A63B 53/047 473/291
2012/0295729 A1 11/2012 Matsunaga

FOREIGN PATENT DOCUMENTS

JP 2000135300 A * 5/2000
JP 2001198243 A * 7/2001
JP 2012-239600 A 12/2012

* cited by examiner

GOLF CLUB SET

TECHNICAL FIELD

The present invention relates to a set of golf clubs having different loft angles.

BACKGROUND ART

The following patent document 1 discloses a golf club set including golf clubs having different loft angles.

In general, a commercially available golf club set includes golf clubs provided with unified shapes and designs in order to give a sense of relief to the user. Further, in order to obtain flying distances according to the golf club number, a golf club whose loft angle is larger has a shorter club length. Further, in order to make the golf swing balance of the respective golf clubs substantially equal or closer to each other, a golf club having a larger loft angle has a heavier club head mass.

The club head mass is adjusted by changing the length of the hosel so as not to alter the uniformity of the club head design. That is to say, a golf club having a larger loft angle is increased more in the length of the hosel of the club head so as to have a heavier club head mass.

Patent document 1: Japanese Patent Application Publication

SUMMARY OF THE INVENTION

In the above-described conventional golf club set, a golf club having a larger loft angle has a longer hosel, therefore, there is a tendency that the mass of the club head is distributed more on the heel side of the club head. Accordingly, a golf club having a larger loft angle tends to have its center of gravity located more on the heel side.

In such conventional golf club set, there is a tendency such that the golf clubs differ from each other in respect of the returnability.

Here, the term "returnability" means a characteristic feature of a golf club during swing which expresses a capability of retuning the club face back to its initial position (at the time of addressing the ball) at impact. Thus, when the returnability is low, it will result in open face.

The present invention was made in view of the circumstances described above, and a primary object thereof is to provide a golf club set including golf club heads which are comparable in returnability and thereby it is possible to provide constant swing without regard to the golf club number.

According to the present invention, a golf club set includes golf clubs having different loft angles and including weight-embedded golf clubs, each weight-embedded golf club comprising a club head composed of a head main body having a club face for hitting a ball and an internal weight member disposed in the head main body, wherein the internal weight members of the weight-embedded golf clubs are arranged such that the loft angle is lager, the center of gravity of the internal weight member is positioned more on the toe side.

Further, the golf club set according to the present invention may have the following features:

(1) In the weight-embedded golf clubs, each of the head main bodies comprises a hosel, and a golf club having a larger loft angle has the hosel having a larger length;

(2) In the weight-embedded golf clubs, a golf club having a larger loft angle has the center of gravity of the head main body positioned more on the heel side;

(3) In the weight-embedded golf clubs, the difference between a minimum value and a maximum value of the distances of the centers of gravity of the golf club heads is 1.5 mm or less;

(4) The internal weight member is disposed in a sole portion of the club head;

(5) In the weight-embedded golf clubs, each golf club head comprises a fixing member fixed to the head main body so as to cover over the internal weight member;

(6) In the weight-embedded golf clubs, the fixing members have the substantially same contour shapes;

(7) The specific gravity of the fixing member is more than the specific gravity of the head main body, and less than the specific gravity of the internal weight member.

DESCRIPTION OF THE PREFERRED EMBODIMENTS

Figure 1A:
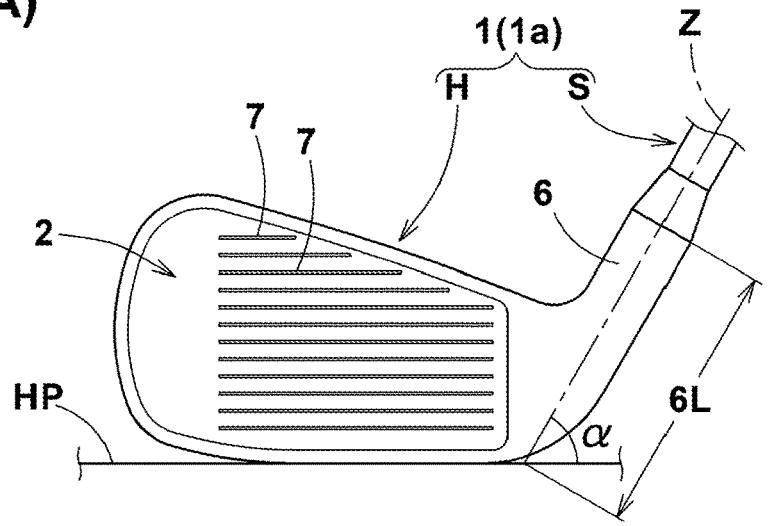
FIGS. 1(A), 1(B) and 1(C) are front views of golf clubs included in a golf club set which have different loft angles and are their standard states.

Embodiments of present invention will now be described in detail in conjunction with accompanying drawings.

According to the present invention, a golf club set includes golf clubs 1 whose golf club heads H have different loft angles β.

In this specification, a golf club set means a set of golf clubs which are dealt as a package or suggested to be dealt as a package by the manufacturer. A typical example is a set of iron golf clubs.

The golf clubs included in the set are provided with unified designs, and configured so as to achieve flying distance ranges intended for the respective clubs according to the different loft angles β.

In the drawings, a golf club set as an embodiment of the present invention is a set of iron golf clubs.

But, the present invention can be applied to a set of utility-type golf clubs, and a set of wood-type golf clubs, for example.

Figure 1B:
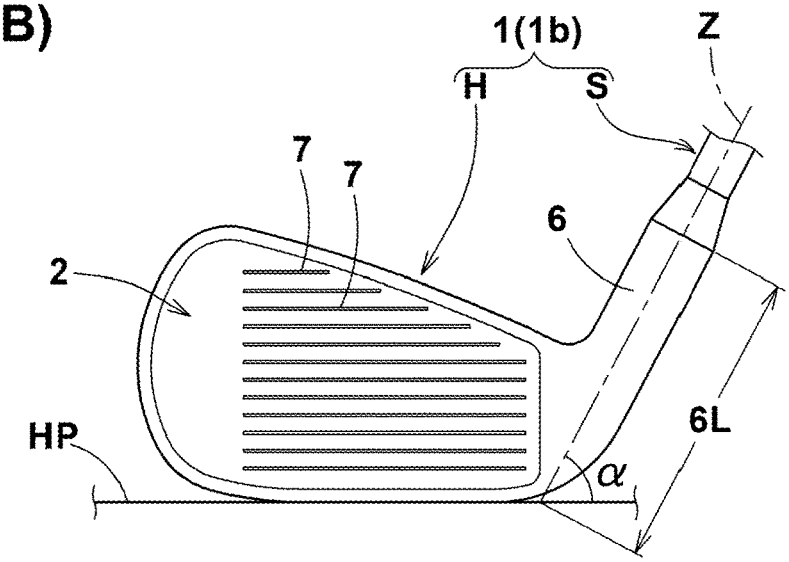
Figure 1C:
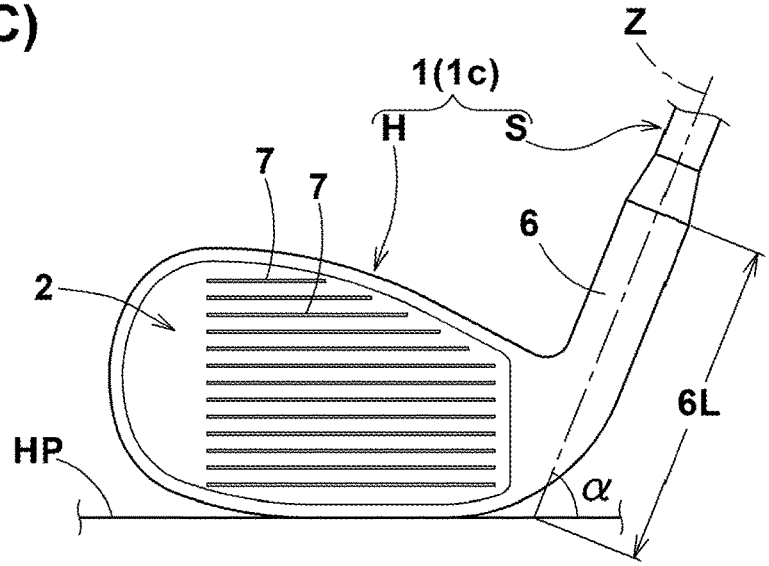

FIGS. 1(A), 1(B) and 1(C) show front views of the golf club heads H of the golf clubs 1 (1*a*, 1*b* and 1*c*) included in the golf club set in this embodiment which are in the respective standard states.

Figure 2A:
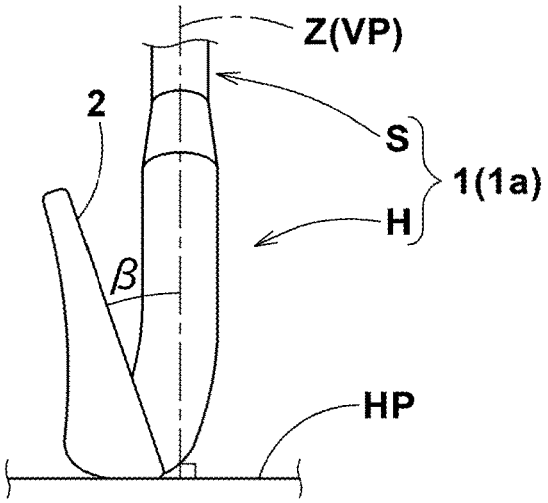
FIGS. 2(A), 2(B) and 2(C) are side views of the golf clubs included in the golf club set have the different loft angles and are the respective standard states.
Figure 2B:
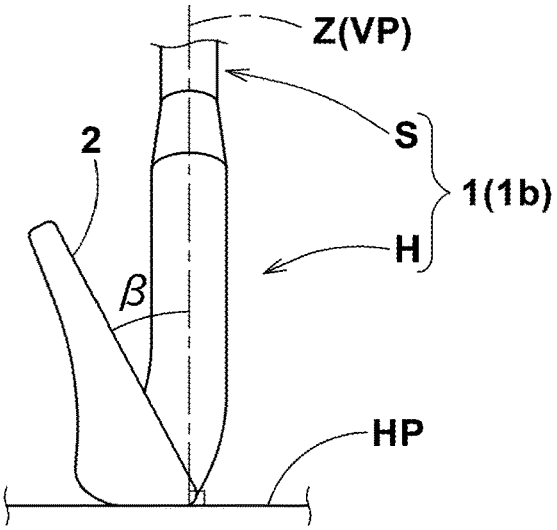
Figure 2C:
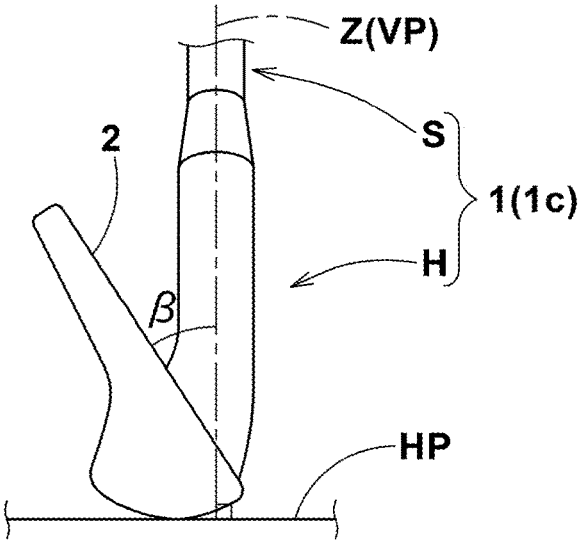

FIGS. 2(A), 2(B) and 2(C) show side views of the golf club heads H viewed from the toe side which are in the respective standard states.

Figure 3:
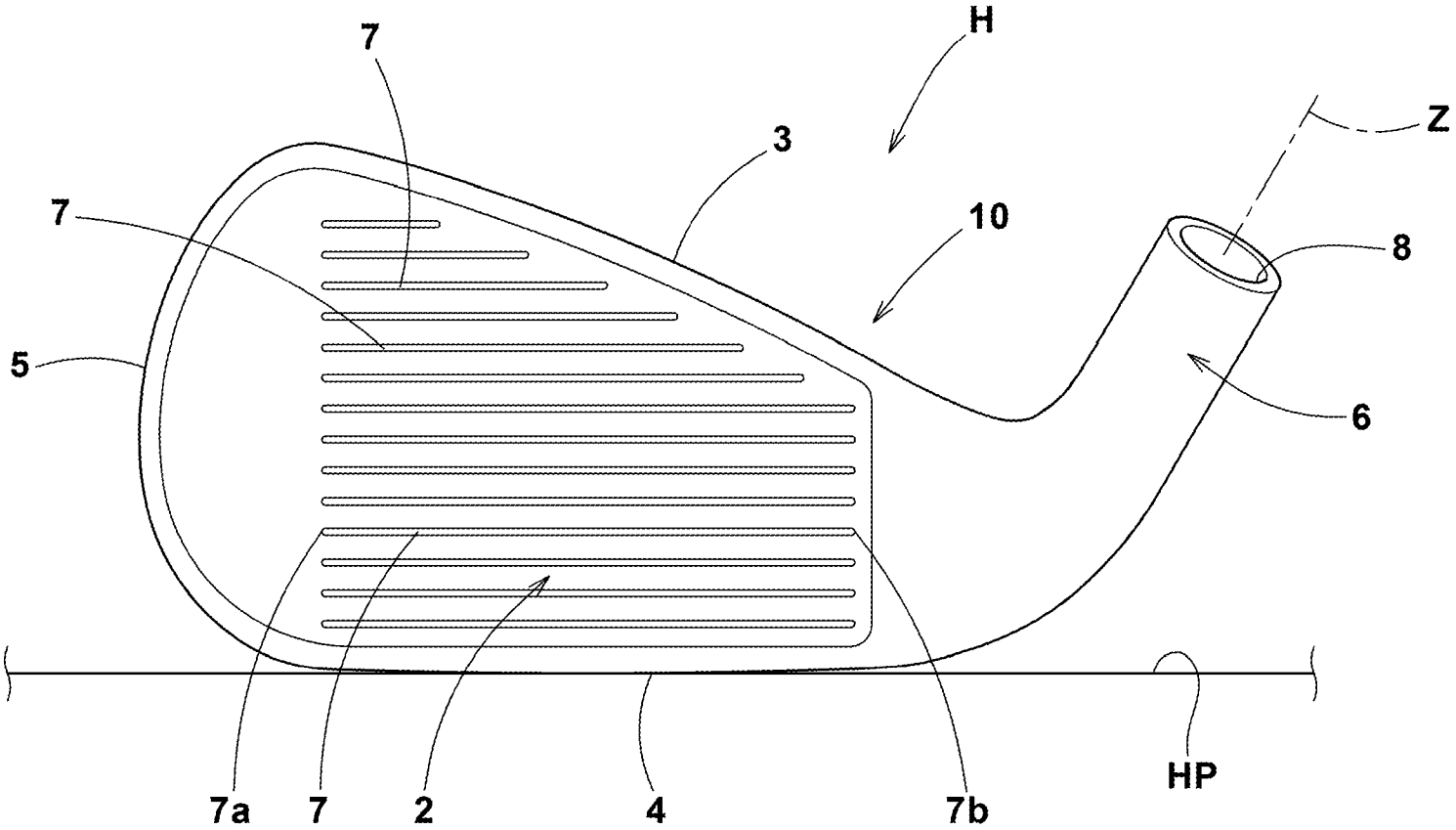
FIG. 3, FIG. 4 and FIG. 5 are a front view, a rear view and a bottom view of a typical example of the golf club head in its forward tilting state.
Figure 4:
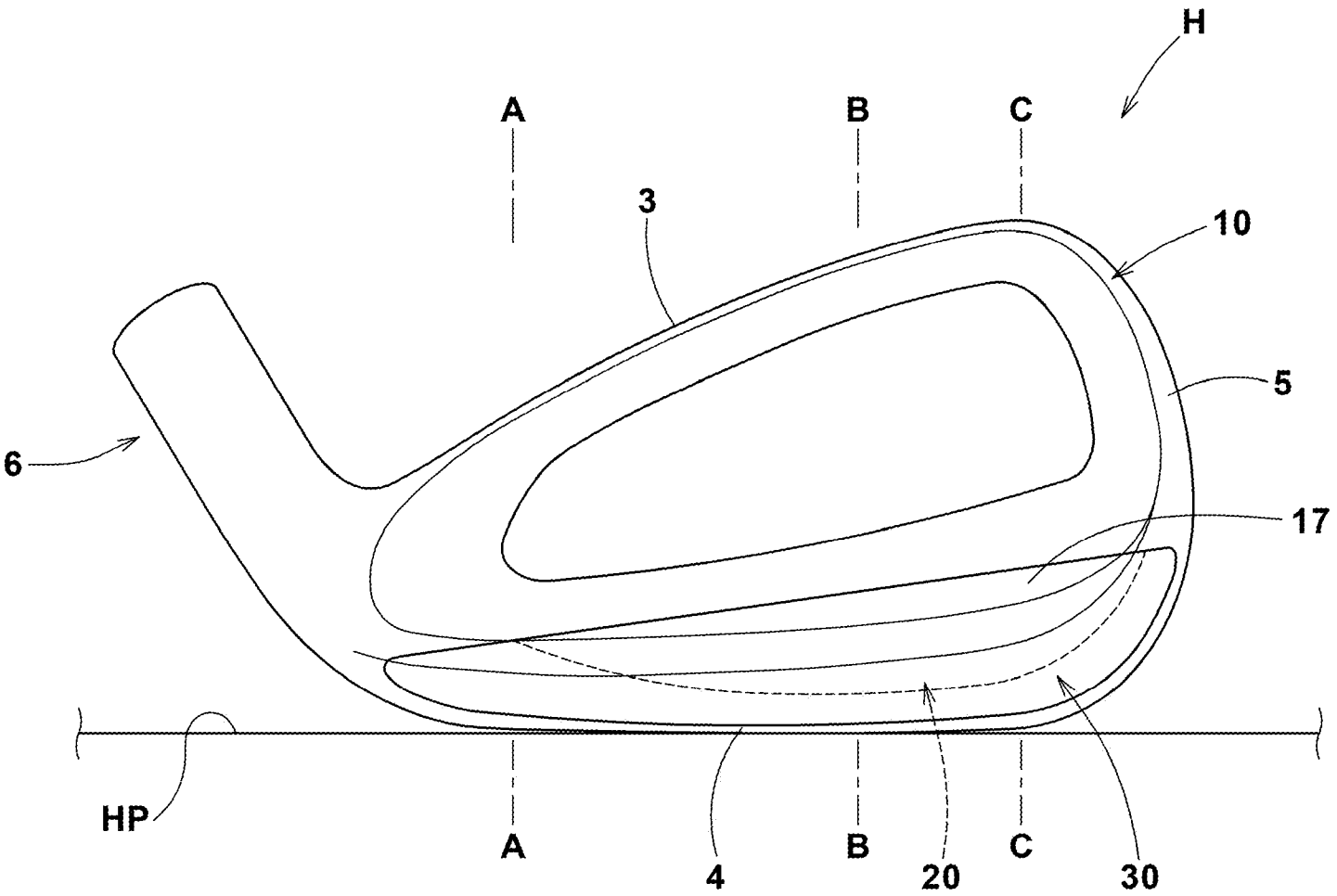
Figure 5:
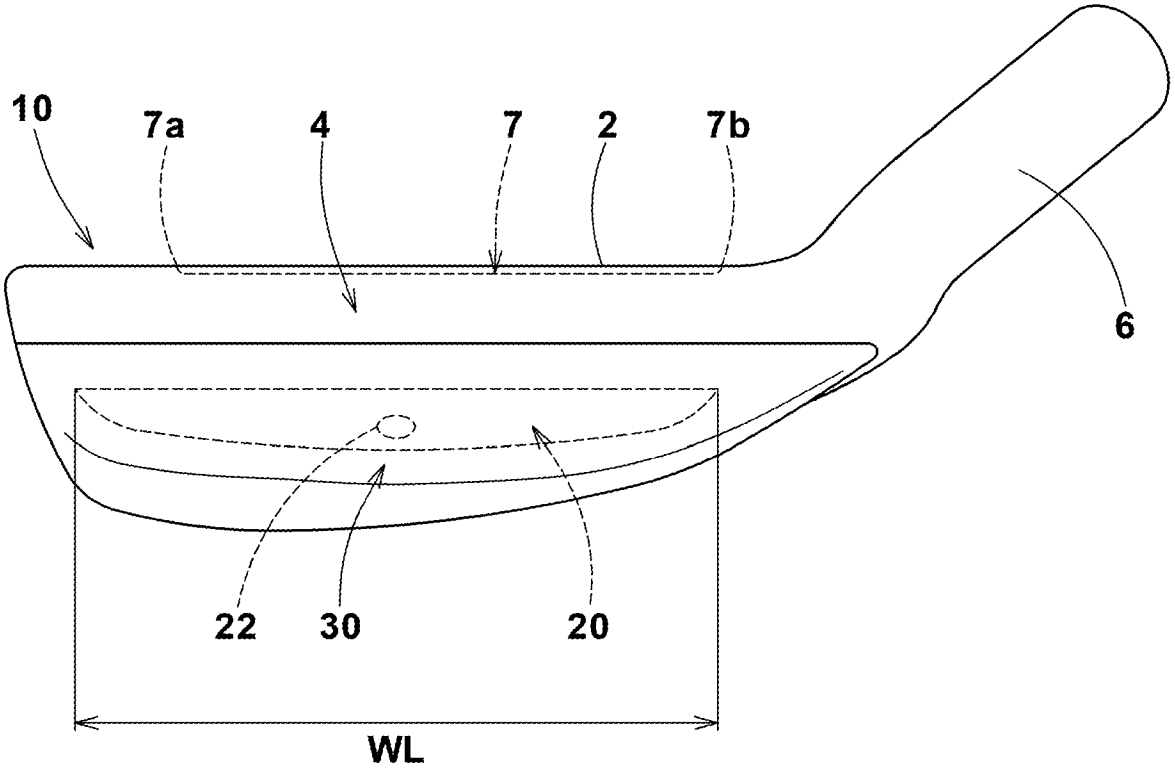

FIG. 3, FIG. 4 and FIG. 5 are a front view, a rear view and a bottom view of a typical example of the golf club head H in its forward tilting state.

Figure 16:
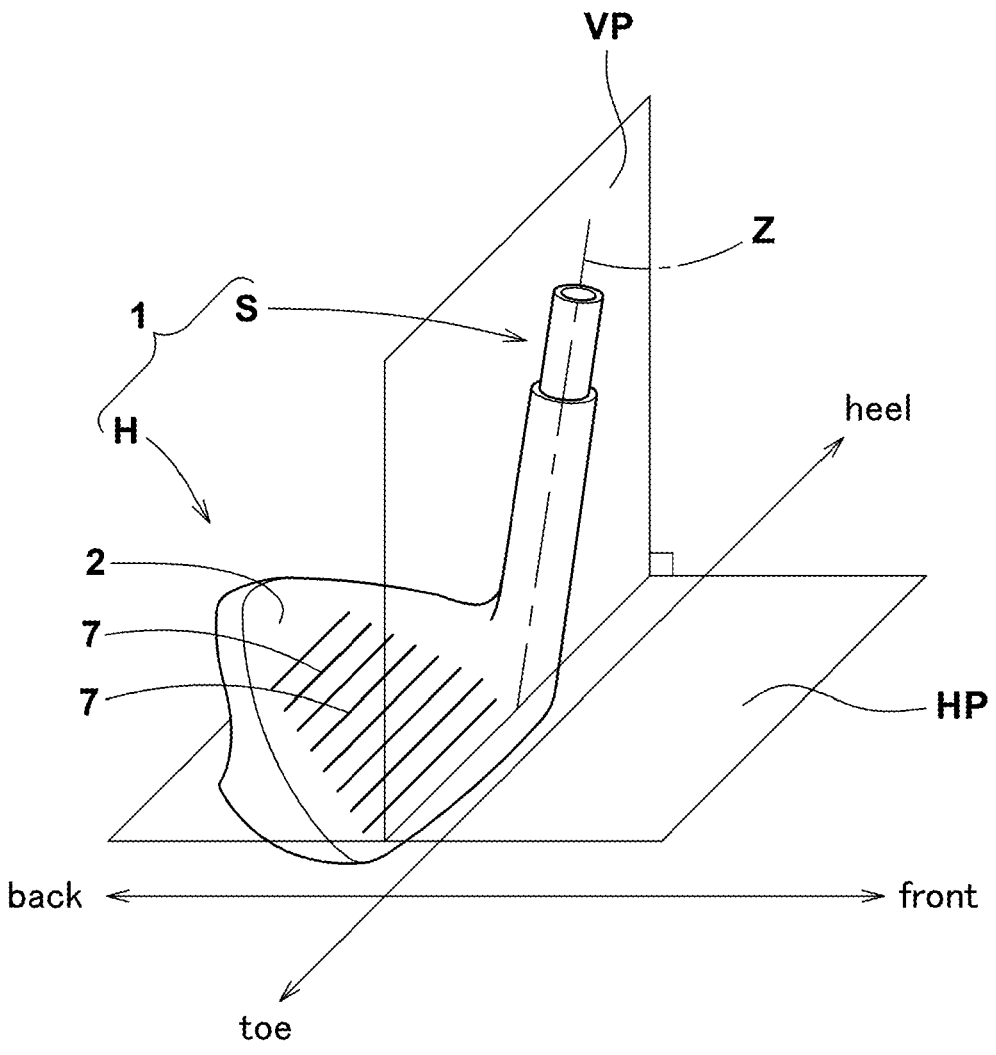
FIG. 16 is a schematic perspective view of a golf club head for explaining the standard state of the golf club head.

The "standard state" of a golf club head H refers to such a state that the golf club head H is set on a horizontal plane HP so that score lines (grooves) 7 formed in the club face 2 become parallel with the horizontal plane HP, and the central axis Z of the clubshaft lies within a vertical plane VP perpendicular to the horizontal plane HP as shown in FIG. 16. In the standard state, the score lines 7 are parallel with the vertical plane VP as well as the horizontal plane HP.

The "forward tilting state" of a golf club head H refers to such a state that the golf club head H under the standard state is rotated around a horizontal axis parallel with the toe-heel direction so that the club face 2 becomes perpendicular to the horizontal plane HP.

In this application including the description and claims, dimensions, positions, directions and the like relating to the club head refer to those under the standard state of the club head unless otherwise noted.

"Toe-heel direction" is a direction parallel with the horizontal plane HP and the vertical plane VP, namely, parallel with the score lines 7.

"Up-down direction" is a direction perpendicular to the horizontal plane HP.

"Front-back direction" is a direction parallel with the horizontal plane HP and perpendicular to the vertical plane VP.

The above-mentioned golf clubs 1*a*, 1*b* and 1*c* have sequential golf club numbers, and the loft angles β of the golf clubs 1*a*, 1*b* and 1*c*, respectively, have the following magnitude relation:

golf club 1*a*<golf club 1*b*<golf club 1*c*.

In the golf club set, the smallest loft angle β is for example set in a range from about 19 to 27 degrees, and the largest loft angle β is for example set in a range from about 44 to 60 degrees.

It is preferable that the difference in the loft angles β between the golf clubs having adjacent golf club numbers is for example set in a range from about 3 to 10 degrees in order that a wide range of flying distances can be covered by the respective golf clubs included in the golf club set.

The number of the golf clubs 1 included in the golf club set is not essential but typically 3 or more, preferably from 5 to 10.

In the golf club set in this embodiment, a golf club 1 having a larger loft angle β has a shorter club length (namely, the clubshaft S is shorter). Further, in the golf club set in this embodiment, a golf club 1 having a larger loft angle β has a larger lie angle α. Furthermore, in the golf club set in this embodiment, a golf club 1 having a larger loft angle β (the club length is shorter) has a heavier club head mass in order to make the golf swing balance of the respective golf clubs substantially equal or closer to each other.

The club head mass is adjusted by mainly changing the length of the hosel 6 so as not to alter the uniformity of the club head design. Specifically, a golf club 1 having a larger loft angle β has a larger length 6L of the hosel 6.

Here, the length 6L of the hosel 6 is measured along the central axis Z of the clubshaft s from the upper end of the hosel to the horizontal plane HP.

In this embodiment, as shown in FIGS. 3 to 7, each golf club head H has a shape which is typical of the iron golf club heads and comprises a club face 2, a top 3, a sole 4, a toe 5 and a hosel 6.

The club face 2 is a substantially flat surface for hitting a golf ball. The club face 2 is provided with score lines (grooves) 7 extending in the toe-heel direction of the club head in order to increase the friction with the ball.

The top 3 is an upper surface of the club head H extending backward of the club head from the upper edge 2*a* of the club face 2.

The sole 4 is a bottom surface of the club head extending backward of the club head from the lower edge of the club face 2.

The toe 5 is a part being most distant from the hosel 6 and smoothly connecting between the top 3 and the sole 4.

The hosel 6 is a part provided with a shaft inserting hole 8 into which a clubshaft S is inserted, and formed in a tubular shape, for example. The center line of the club shaft inserting hole 8 substantially coincides with the central axis Z of the clubshaft S inserted therein.

Some of the golf club heads H in this embodiment each comprise a head main body 10, an internal weight member 20 and a fixing member 30.

In this specification, the golf club comprising the golf club head H provided with the internal weight member 20 is called as "weight-embedded golf club".

The golf club set in this embodiment includes two our more, preferably three or more, more preferably four or more weight-embedded golf clubs.

The head main body 10 is a component part constituting a major part of the golf club head H. The head main body 10 in this example comprises the club face 2 provided with the score lines (grooves) 7, the top 3, the sole 4, the toe 5 and the hosel 6.

The head main body 10 is, for example, made of a metal material or metal materials.

Figure 7:
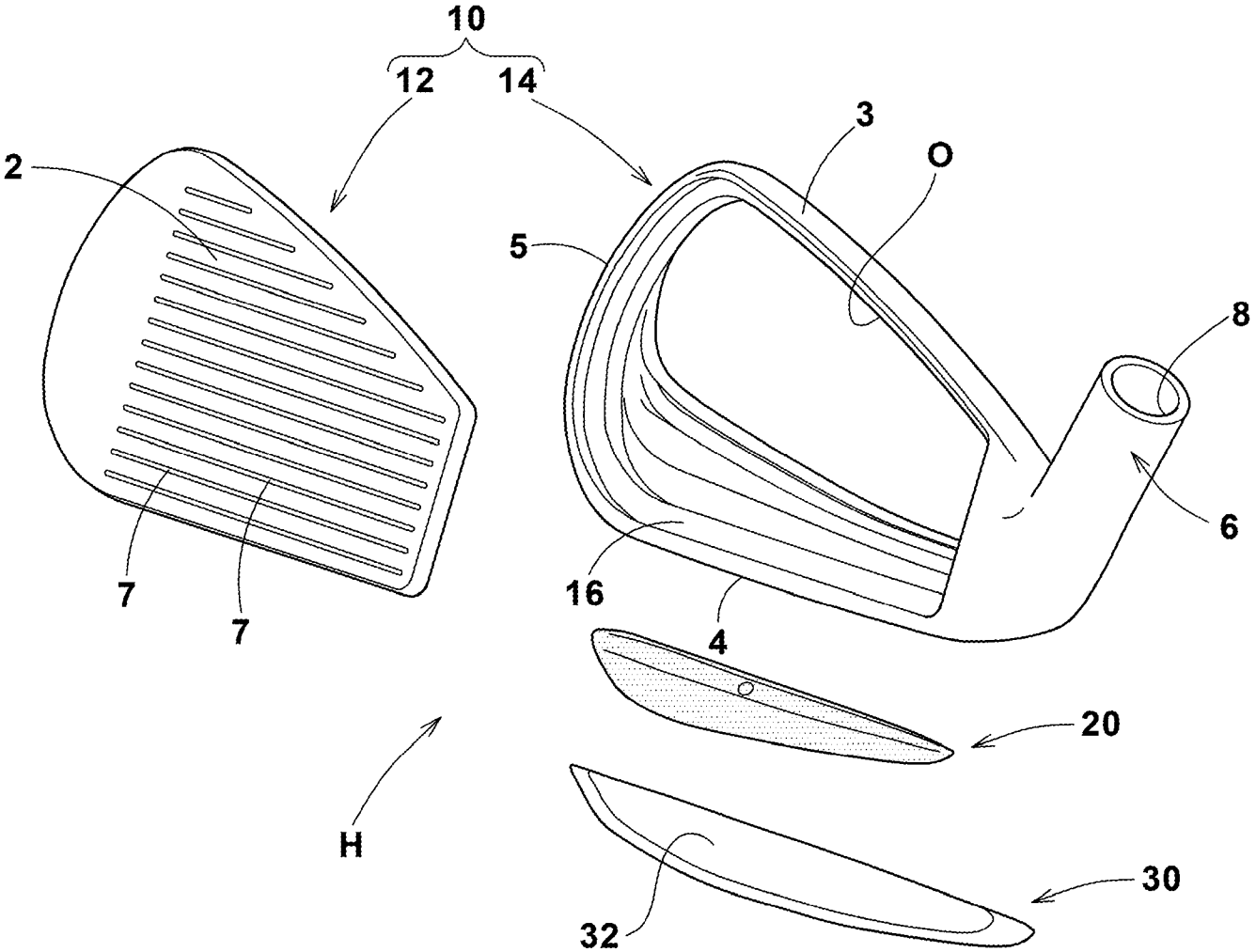
FIG. 7 and FIG. 8 are exploded perspective views showing an example of the structure for the golf club heads.

Preferably, the head main body 10 is composed of a face plate 12 and a face plate receiving part 14 as shown in FIG. 7. The face plate 12 is made of a metal material, and the face plate receiving part 14 is made of a metal material different from the face plate 12.

Preferably, the metal material of the face plate 12 has a specific gravity lowest in the metal materials forming the golf club head H in order to set the position of the center of gravity more backward of the club head.

For example, the face plate 12 is preferably made of a titanium alloy having a specific gravity of 4.5 or less.

The face plate receiving part 14 in this example is provided with a through hole penetrating therethough in the front-back direction of the club head to have a front opening O, and surround by the top 3, the sole 4 and the toe 5.

Further, the face plate receiving part 14 integrally includes the hosel 6.

The face plate receiving part 14 comprises a face plate mounting portion 16, which is formed around the opening O, and to which the peripheral edge portion of the face plate 12 is fixed. By fixing the face plate 12 to the face plate mounting portion 16, the front opening O is closed by the face plate 12.

The face plate 12 and the face plate receiving part 14 can be united with each other by using various techniques, for example, welding, brazing, adhesive agent, caulking and the like.

Preferably, the face plate receiving part 14 is made of an iron base alloy having higher strength and good workability such as stainless and carbon steel. Preferably, the iron base alloy has a specific gravity of not less than 7.0, more preferably not less than 7.5. Thus, it is possible to locate the center of gravity G more backward of the club head.

As another example, the head main body 10 can be made of a single kind of material or three or more kinds of materials.

In the case of the head main body 10 made of a single kind of material, a typical example is the head main body 10 having one piece structure without the separate face plate 12 and face plate receiving part 14.

Another example is the head main body 10 having two piece structure comprising the separate face plate 12 and face plate receiving part 14 both made of an identical material and united with each other.

In the case of the head main body 10 made from three or more kinds of materials, the face plate receiving part 14 is composed of two or more separate parts, and the face plate 12 is fixed thereto.

Figure 6A:
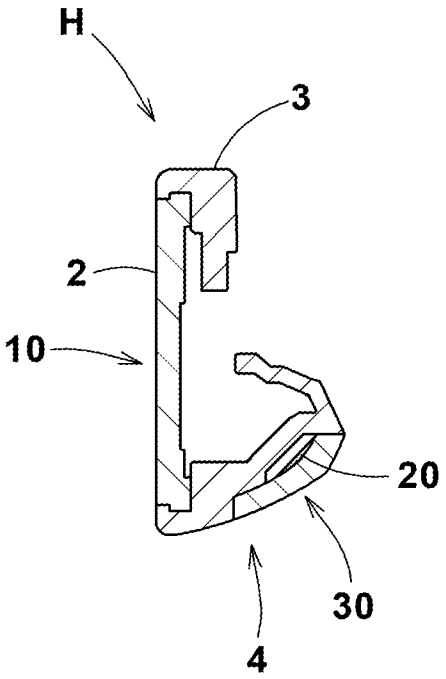
FIGS. 6(A), 6(B) and 6(C) are cross sectional views taken along line A-A, line B-B and line C-C of FIG. 4, respectively.
Figure 6B:
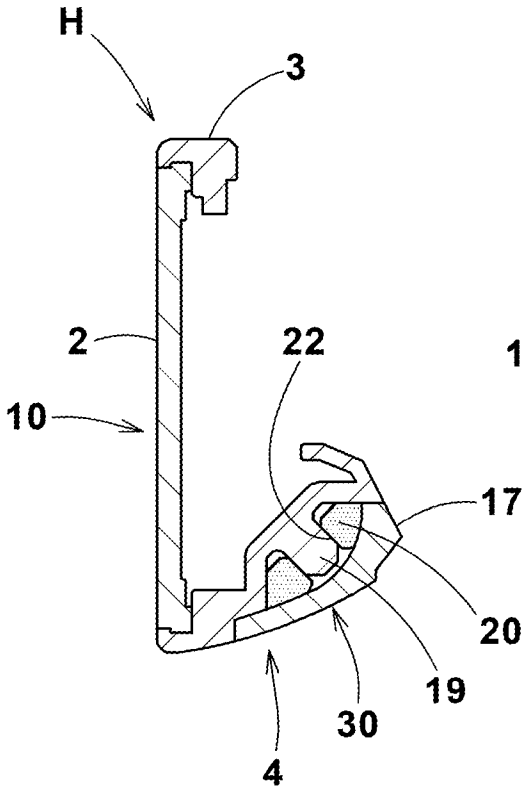
Figure 6C:
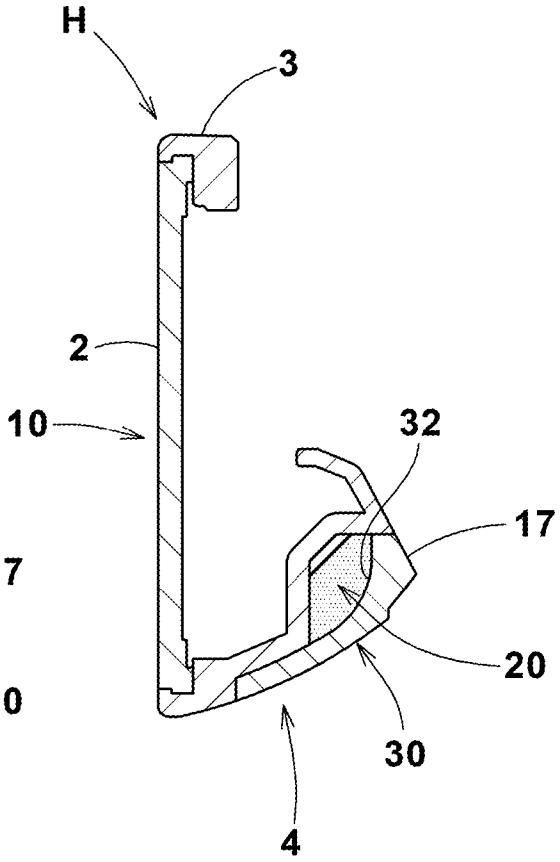
Figure 8:
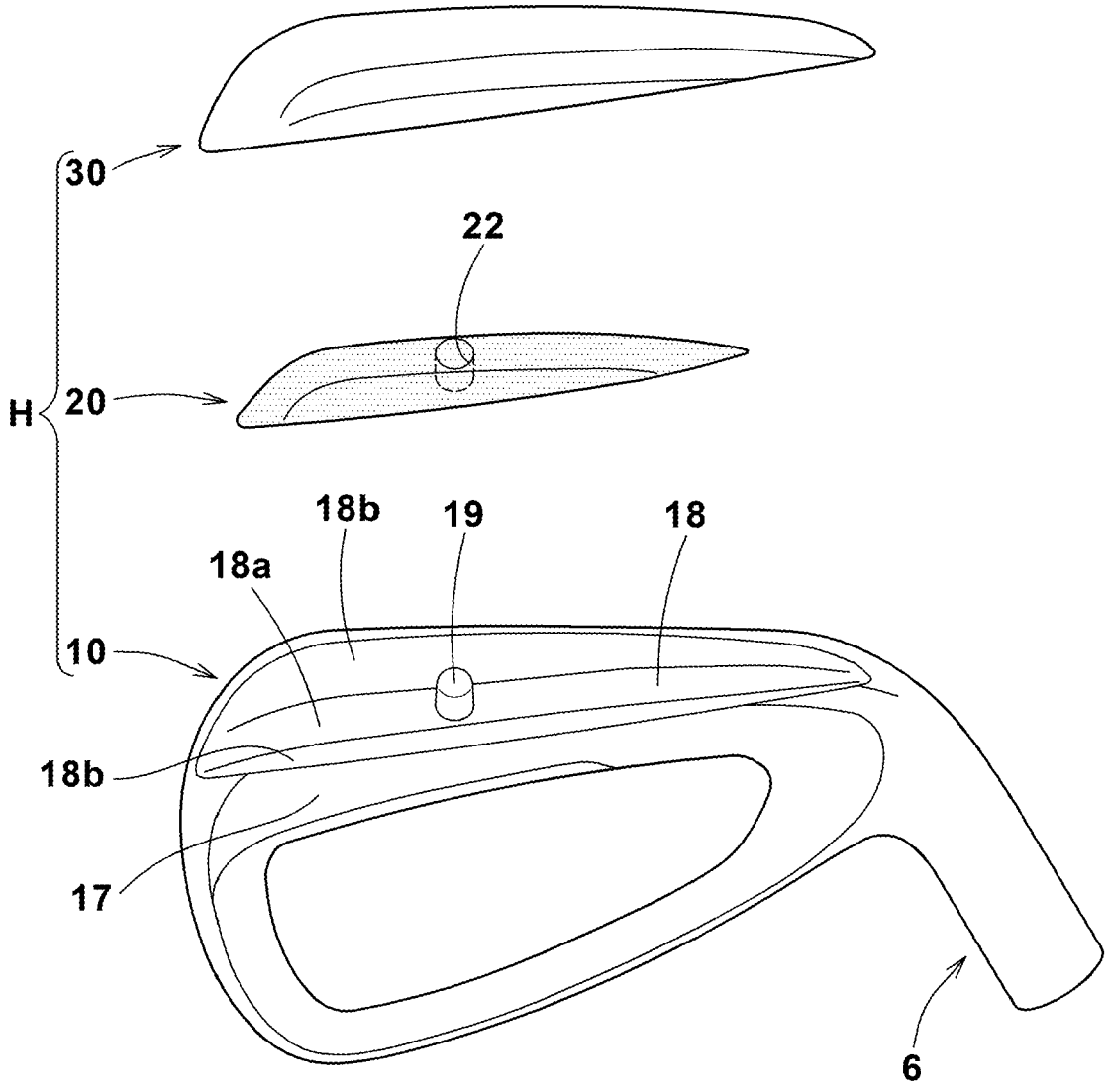

For example, as shown in FIG. 6 and FIG. 8, the head main body 10 is provided with a concave portion 18 depressed from a virtual surface corresponding to the outer surface of the club head. In this embodiment, the undermentioned weight member 20 and fixing member 30 are disposed in the concave portion 18, and the outer surface of the club head is formed.

In this embodiment, the concave portion 18 is formed in the form of a groove extending long in the toe-heel direction in a sole 4 side, specifically, in the sole of the face plate receiving part 14.

The internal weight member 20 is made of a metal material having a specific gravity larger than a specific gravity of the head main body 10.

Incidentally, the specific gravity of the club head main body 10 is determined from the mass and volume of the club head main body 10 regardless of whether the head main body 10 is composed of one or more component parts or one or more different materials.

In this embodiment, the internal weight member 20 is disposed in a sole side and rear side in order to shift the center of gravity G of the club head downward and backward of the club head.

As shown in FIG. 7 and FIG. 8, the internal weight member 20 in this example extends long in the toe-heel direction. Specifically, the length WL in the toe-heel direction of the internal weight member 20 is set to be not less than the length in the toe-heel direction from the toe-side most end 7*a* to the heel-side most end 7*b* of the score lines (grooves) 7 as shown in FIG. 5. The cross-sectional area measured perpendicularly to the toe-heel direction of the internal weight member 20 is gradually decreased toward both sides in the toe-heel direction. In view of easiness of adjusting the position of the center of gravity G of the club head and easiness of swinging the golf club, it is preferred that the mass of the internal weight member 20 is set in a range from about 7% to 12% of the mass of the club head.

The internal weight member 20 can be made of a tungsten-nickel-iron alloy comprising W, Ni and Fe. The specific gravity of the internal weight member 20 is not essential, but preferably 10.0 or more, more preferably 12.0 or more, and preferably 18.5 or less. In order to reduce the size of the weight member to improve the production efficiency and increase the flexibility of designing the head, a higher specific gravity is preferred.

The tungsten-nickel-iron alloy achieves a high specific gravity by increasing the tungsten content relatively to the iron content. When the tungsten content of the alloy is increased, the weldability with the iron base alloy such as soft iron, stainless and carbon steel, namely, the head main body 10 is decreased. This means that it is difficult to strongly fix the weight member 20 to the head main body 10 by using a simple welding technique.

In this embodiment, the internal weight member 20 is made of the tungsten-nickel-iron alloy whose tungsten content is too increased to weld it to the head main body 10.

The internal weight member 20 is disposed in the concave portion 18. The volume of the internal weight member 20 is set to smaller than the volume of the concave portion 18.

The internal weight member 20 comes into contact with at least part of the surface of the concave portion 18 as explained hereunder.

The fixing member 30 is fixed to the head main body 10 and covers the internal weight member 20, for example, as shown in FIG. 4 to FIG. 6.

The fixing member 30 is made of a metal material capable of being fixed to the head main body 10 by welding.

Preferably, the specific gravity of the metal material of the fixing member 30 is more than the specific gravity of the club head main body 10, and less than the specific gravity of the internal weight member 20.

In this arrangement, the mass of the fixing member 30 can be used to design the position of the center of gravity G of the club head in addition to the mass of the internal weight member 20.

Metal materials suitable for the fixing member 30 include a tungsten-nickel-iron alloy comprising W, Ni and Fe which is decreased in the tungsten content as compared with the tungsten-nickel-iron alloy of the weight member 20, while having a higher specific gravity than the head main body 10 and having a higher weldability (joint strength) with the head main body 10 than the internal weight member 20.

The specific gravity of such fixing member 30 is preferably set in a range from 8.0 to 10.0.

The fixing member 30 in this embodiment is fixed to the head main body 10 so as to completely cover over the internal weight member 20 as shown in FIG. 4 to FIG. 6.

Therefore, the internal weight member 20 is disposed inside the club head without being exposed in the outer surface of the club head, and invisible from the outside of the club head.

Thus, even if the gold clubs are different from each other in respect of the shape and position of the internal weight member 20, it is possible to provide unified designs for the club heads since the different shapes and positions of the internal weight members are invisible.

The fixing member 30 in this example is fixed to the head main body 10 by welding. It is preferred that the fixing member 30 is welded to the head main body 10 along the entire peripheral edge of the fixing member 30 in order to increase the joint strength.

It is preferred that as shown in FIGS. 6 (A), (B) and (C) and FIG. 7, the fixing member 30 has an inside surface 32 at least partially contacting with and pressing the outside surface of the internal weight member 20 in order to prevent movements and backlash of the internal weight member 20.

In this embodiment, the fixing member 30 forms at least part of the back face 17.

Here, the back face 17 means a surface of the golf club head H which is visible in the rear view of the iron golf club head H under the forward tilting state as shown in FIG. 6. In this arrangement, owing to the mass of the fixing member 30, the center of gravity G of the club head can be positioned more backward.

The fixing member 30 may form at least part of the sole 4. In this arrangement, owing to the mass of the fixing member 30, the position of the center of gravity G of the club head can be further lowered.

As another example, the fixing member 30 may cover only a part of the internal weight member 20. In this arrangement, there is a possibility that a part of the internal weight member 20 may be viewable from the outside of the club head.

However, it will not degrade the appearance of the club head and not decrease the degrees of freedman of designing since only a part is viewable. Thus, the internal weight member 20 includes such an example only a part of which is secured between the head main body 10 and the fixing member 30.

Figure 9A:
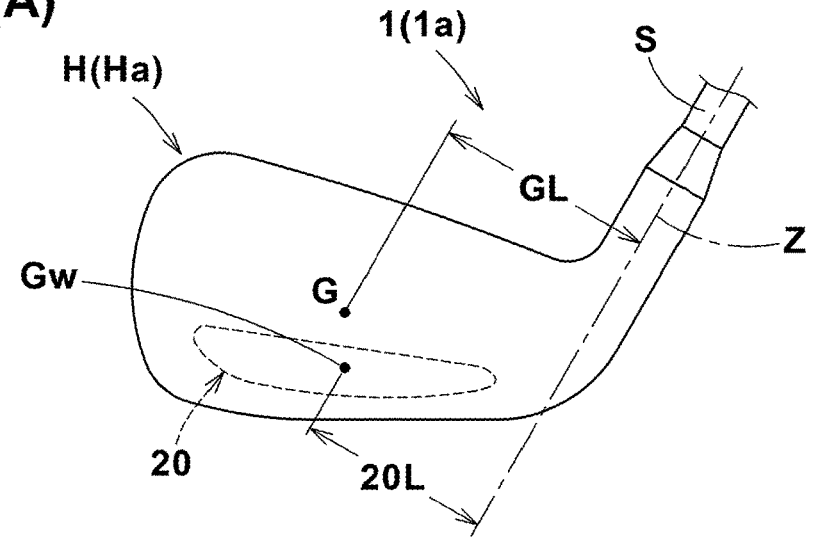
FIGS. 9(A), 9(B) and 9(C) are schematic front views of the golf clubs included in the golf club set which have different loft angles and are the respective standard states.
Figure 9B:
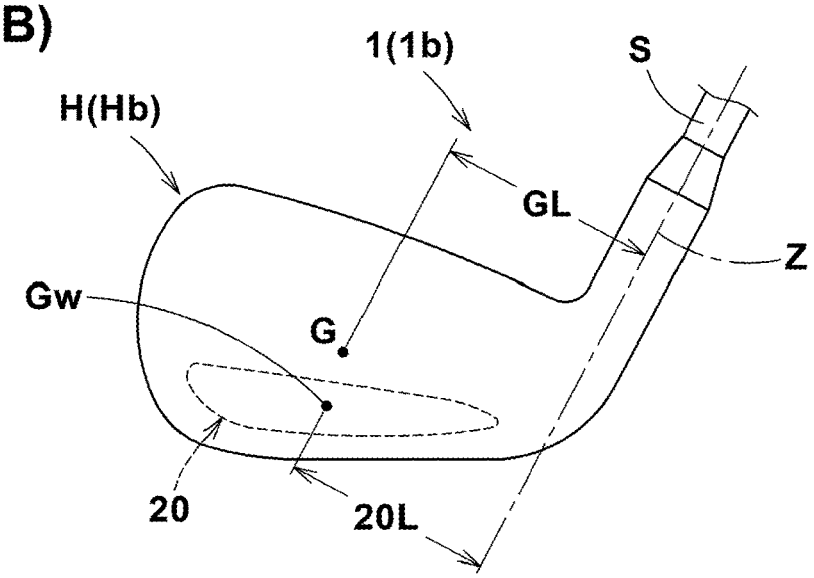
Figure 9C:
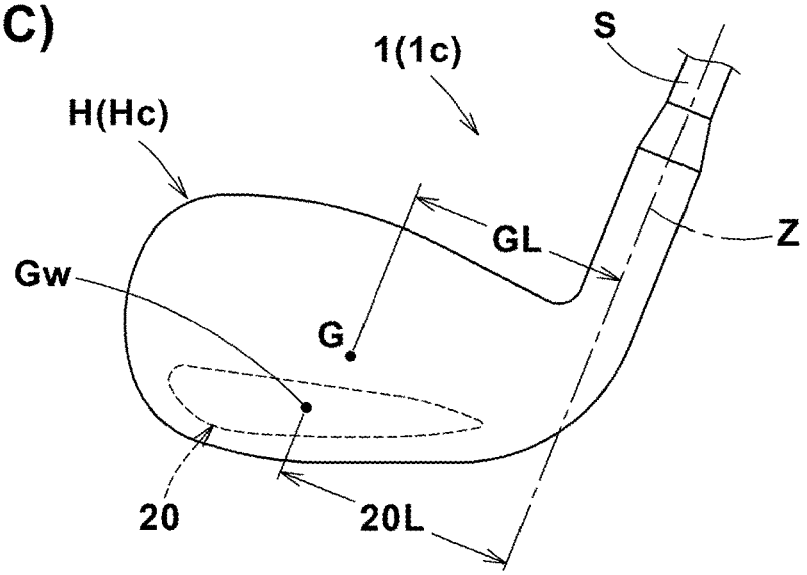

FIG. 9 shows the front views of three golf clubs 1 (1*a*, 1*b* and 1*c*) under the respective standard states which are selected from the weight-embedded golf clubs.

The golf clubs 1 (1*a*, 1*b* and 1*c*) have sequential golf club numbers, and the loft angles β of the club heads Ha, Hb and Hc of the golf clubs 1*a*, 1*b* and 1*c*, respectively, have the following magnitude relation:

golf club head Ha<golf club head Hb<golf club head Hc.

In the weight-embedded golf clubs in the golf club set in this embodiment, a golf club head having a larger loft angle has the center of gravity Gw of the internal weight member 20 positioned more on the toe side.

Here, the position of the center of gravity Gw of the internal weight member 20 is defined by the distance 20L measured from the center of gravity Gw to the central axis Z of the clubshaft S in the normal direction thereto in the front view (or rear view) of the golf club head H in the standard state. Therefore, the golf club head H having a larger loft angle has a larger distance 20L from the center of gravity Gw to the central axis Z.

It is possible to provide two or more internal weight members 20 in the golf club head H of a weight-embedded golf club.

Figure 10A:
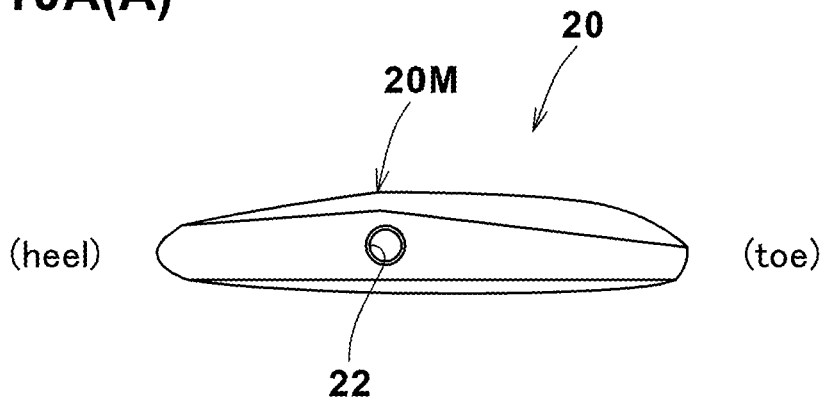
FIGS. 10A(A), 10A(B) and 10A(C) are top views of the internal weight members of the golf clubs included in the golf club set which have different loft angles.
Figure 10A:
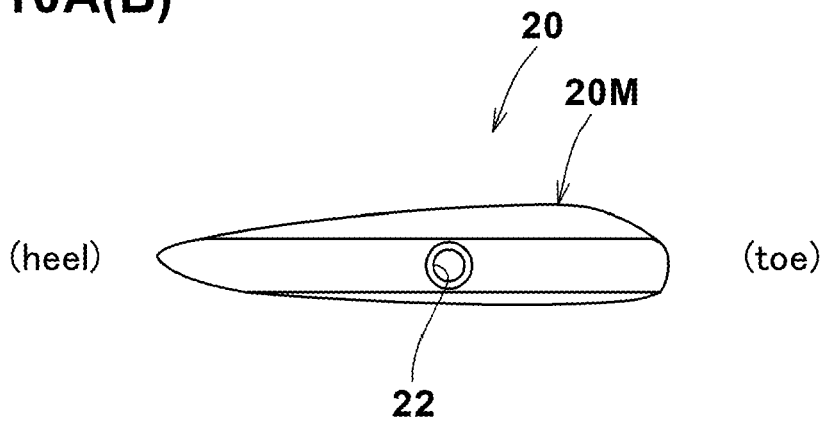
Figure 10A:
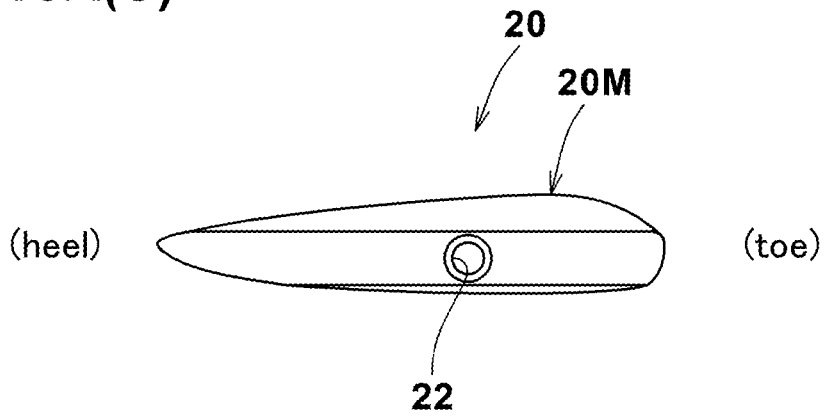
Figure 10B:
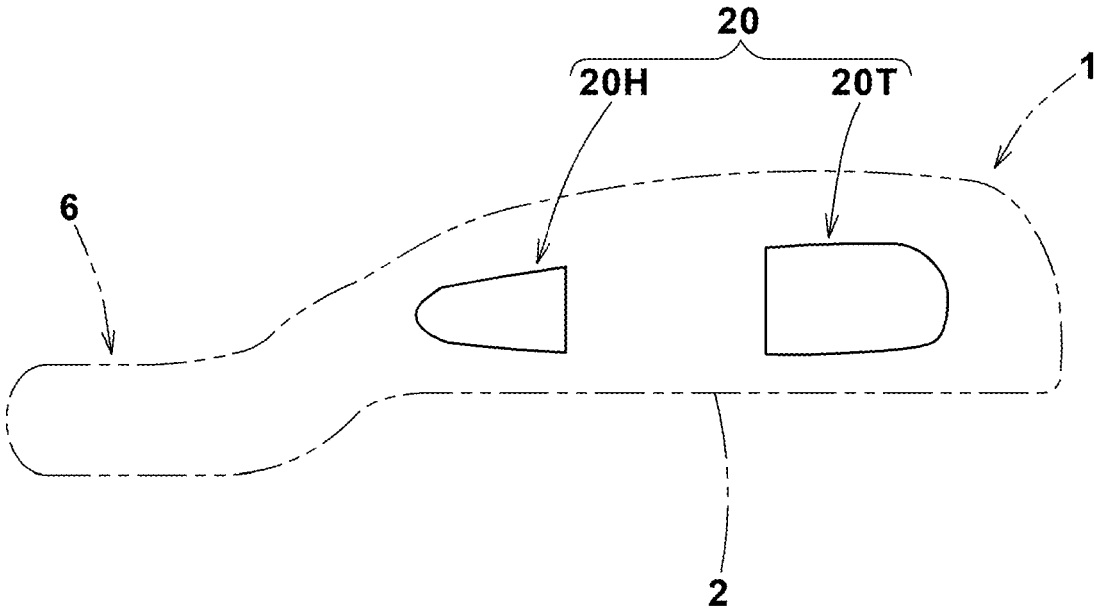
FIG. 10B is a top view showing another example of the internal weight member of the golf club.

FIG. 10B shows a typical example in which the internal weight member 20 includes an internal weight member 20T on the toe-side and an internal weight member 2H on the heel-side. When a plurality of internal weight members (e.g. 20T and 20H) are disposed in a golf club head H, then, taking all the weight members as a single mass, the center of gravity of the weight members 20 is defined by that of the single mass.

In the conventional golf club sets, there is a tendency that a golf club head having a larger loft angle has the center of gravity of the club head located more on the heel side (namely, the distance 20L is shorter).

In the golf club set according to the present invention, on the other hand, a golf club head H having a larger loft angle β has the center of gravity Gw of the internal weight member 20 located more on the toe side. Thereby, it becomes possible to equalize the distances GL of the centers of gravity G of the club heads of the weight-embedded golf clubs.

As shown in FIGS. 9(A), 9(B) and 9(*c*), the distance GL of the center of gravity G of the golf club head H is measured from the center of gravity of the club head to the central axis Z of the clubshaft S in the direction perpendicular to the central axis Z in the front view (or rear view) of the golf club head H in the standard state.

The distance GL of the center of gravity G is considered as a major factor for the returnability of the golf club head H during swing. By equalizing the distances GL of the centers of gravity G of the golf club heads H, it becomes possible to make the weight-embedded golf clubs in the golf club set uniform in respect to the returnability of the club head during swing. Consequently, it becomes possible to make the swing stable.

The positions of the internal weight members 20 are not to be limited especially as far as the distances GL are equalized.

Preferably, the distances GL of the centers of gravity G of the golf club heads H of the weight-embedded golf clubs are the substantially same, more specifically, the difference between the maximum value and the minimum value of the distances GL of the centers of gravity G of the golf club heads H is set in a range of not more than 2.0 mm, preferably not more than 1.5 mm.

The distance GL of the center of gravity G of each weight-embedded golf club is preferably set to be 40.0 mm or less, more preferably 39.0 mm or less in order to increase the returnability of the club head.

On the other hand, if the distance GL of the center of gravity G too small, there is possibility that the golf club head H rotates during swing beyond the initial position (thus, the face is closed) at impact, and the directionality of the hit ball becomes unstable. In this light, the distance GL of the center of gravity G is preferably 31 mm or more.

The position of the center of gravity Gw of the internal weight member 20 can be adjusted by changing the position of the internal weight member 20 relative to the head main body 10, the shape and/or size of the internal weight member 20.

In order to shift the position of the center of gravity Gw of the internal weight member 20 toward the toe, for example, the following measures may be adopted:

- to shift the position of the internal weight member 20 toward the toe, and/or
- to make a toe-side part larger than a heel-side part of the internal weight member 20.

FIGS. 10A(A), 10A(B) and 10A(C) show top views of the internal weight members 20 of the golf club heads Ha, Hb and Hc, respectively. As shown, each of the internal weight members 20 has a shape long in the toe-heel direction.

The internal weight members 20 have the substantially same dimensions in the toe-heel direction, for example, 68 mm±3 mm.

The internal weight members 20 are made of a metal material and all have the same specific gravity.

The internal weight members 20 each have a maximum width portion 20M in which the dimension in the width direction perpendicular to the toe-heel direction becomes maximum.

In the internal weight member 20 in this example, the dimension in the width direction is continuously decreased from the maximum width portion 20M toward the toe and toward the heel. The internal weight members 20 may have the maximum width portions 20M at different positions in the toe-heel direction. In this embodiment, the internal weight member 20 of a golf club head H having a larger loft angle has the maximum width portion 20M positioned more on the toe side relatively to the internal weight member 20.

In the case of another example in which two or more internal weight members (20T and 20H) are disposed as shown in FIG. 10B, the position of the center of gravity of the internal weight members 20 as a whole can be adjusted by using different specific gravities for the internal weight members (20T and 20H) without changing the arrangement positions and shapes of the internal weight members.

More specifically, for example, while making the shapes and positions of the toe-side and heel-side internal weight members 20T and 20H substantially the same for all the weight-embedded golf clubs, the difference of the specific gravity of the toe—the side internal weight member 20T from the specific gravity of the heel-side internal weight member 20H is made larger for a golf club head having a larger loft angle. By adopting such arrangement in the weight-embedded golf clubs, it is possible to position the center of gravity Gw of the internal weight member 20 more on the toe side for a golf club head having a larger loft angle.

When the positions of the centers of gravity Gw of the internal weight members 20 of the golf club heads H are different from each other, then the golf clubs become different from each other in respect to the shape and arrangement of the internal weight member 20.

In this embodiment, as shown in FIG. 4 to FIG. 6, as the fixing member 30 is fixed to the head main body 10 so as to completely cover over the internal weight member 20, the internal weight member 20 is not visible from the outside of the club head. In the golf club set in this embodiment, therefore, it is possible to provide unified shapes and designs for the club heads since the different shapes and positions of the internal weight members 20 are invisible.

Figure 11A:
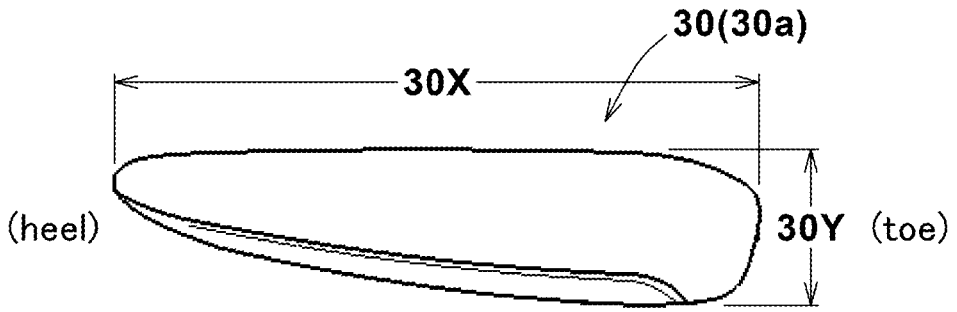
FIGS. 11(A), 11(B) and 11(C) are top views of the fixing members of the golf clubs included in the golf club set which have different loft angles.
Figure 11B:
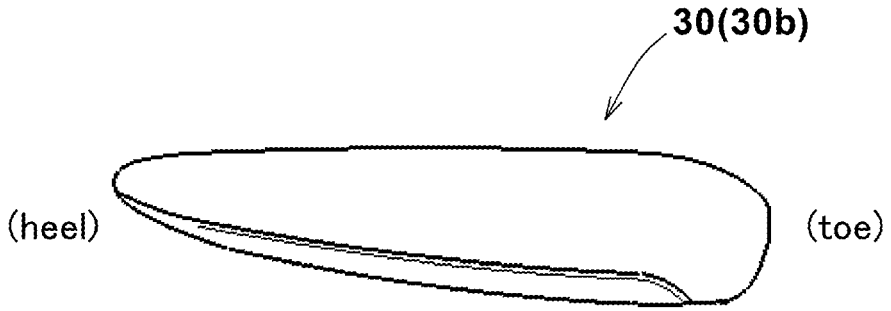
Figure 11C:
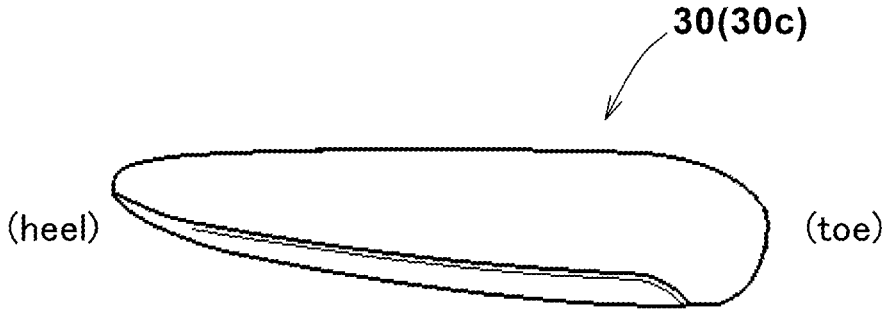

As shown in FIGS. 11(A), 11(B) and 11(C) which show the plan views of the fixing members 30 (30*a*, 30*b* and 30*c*) of the golf club heads Ha, Hb and Hc, respectively, each fixing member 30 has a length 30X in the toe-heel direction, and a width 30Y in the direction perpendicular to the toe-heel direction. Preferably, the fixing members 30 of the weight-embedded golf clubs have the substantially same contour shapes which look similar at the first glance. In the fixing members 30, preferably, the variation in the length 30X and the variation in the width 30Y are both limited to at most 3 mm.

Thereby, the golf club heads become the substantially same in respect to the junction position between the fixing member 30 and the head main body 10.

When a weld junction is formed on the outer surface of the club head, the outer surface is usually satin finished or coated with paint in order to make it less noticeable. Mirror finish is not suitable. Accordingly, if golf clubs included in a golf club set are different in the position of the weld junction existing on the outer surface of the club head, it becomes difficult to make unified finishing for all the club heads.

In contrast, by employing the fixing members 30 in this embodiment, it becomes possible to make unified finishing for all the golf club heads H included in the golf club set.

Design 1

Figure 12:
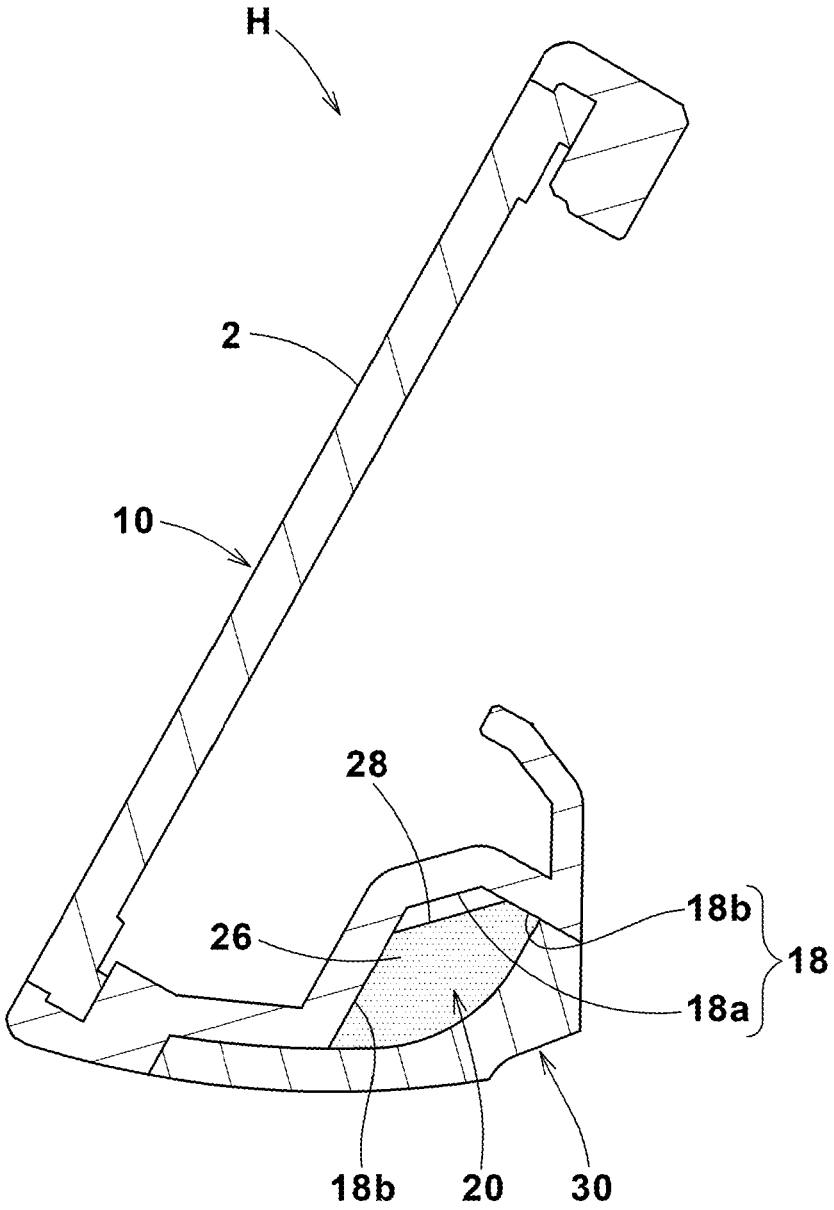
FIG. 12 is an enlarged cross sectional view of a golf club head.

As shown in FIG. 12, the concave portion 18 of the club head main body 10 may comprises a bottom face 18*a* denting from the outer surface of the club head, and a pair of slant faces 18*b* arranged in a taper fashion tapering towards the bottom face. Preferably, one of the slant faces 18*b* is parallel with the club face 2, and the other is orthogonal to the club face 2.

The bottom face 18*a* is a flat face and intersects with each of the slant faces 18*b* at an obtuse angle, for example, about 135 degrees.

Meanwhile, the internal weight member 20 is provided with a tapered part 26 fitted between a pair of the slant faces 18*b*, and the surfaces of the tapered part 26 at least partially contact with the respective slant faces 18*b*. However, a truncated face 28 formed at the tip end of the tapered part 26 does not contact with the bottom face 18*a* of the concave portion 18 and a gap is formed. Preferably, the gap is 0.5 mm or more. Thereby, the slant faces 18*b* fix the position of the weight member 20 and prevent movements (in the toe-heel direction, front-back direction and upward direction) of the weight member 20 within the club head, therefore, generation of abnormal noise when hitting the ball due to backlash or vibrations of the weight member 20 within the club head can be prevented. Incidentally, the tapered part 26 does not require extremely high working accuracy, thereby, the production efficiency may be improved.

Design 2

Figure 13:
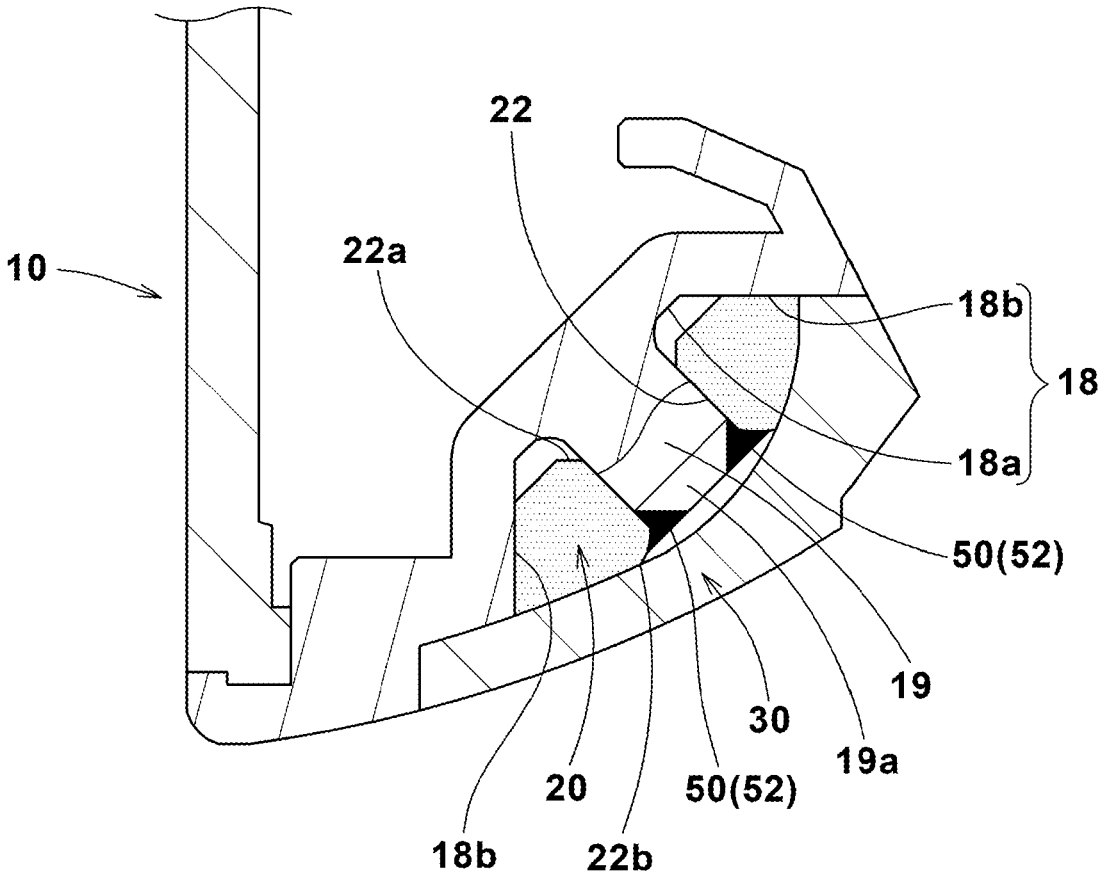
FIG. 13 is a closeup of a part of FIG. 6(B).

As shown in FIG. 6(B) and FIG. 13, the concave portion 18 of the club head main body 10 may be provided with at least one projecting part 19 protruding toward the outside of the club head in addition to or instead of the above desirable design 1. In this example, the projecting part 19 is formed in the bottom face 18*a* of the concave portion 18.

The projecting part 19 in this example is substantially column-shaped. But, the shape of the projecting part 19 is not to be limited thereto.

In this example, only one projecting part 19 is provided. But, two or more projecting parts may be provided in the concave portion 18.

Corresponding to the position of the projecting part 19, the internal weight member 20 is provided with a through-hole 22 into which the projecting part 19 is fitted. Thereby, backlash and vibrations can be prevented. Thus, by combining this design 2 with the above described design 1, the vibrations and backlash and the resulting abnormal noise can be effectively prevented. As shown in FIG. 5, the through-hole 22 is preferably disposed in a central portion in the length direction of the internal weight member 20 to effectively prevent backlash and vibrations of the internal weight member 20.

Here, the length direction of the internal weight member 20 means a direction in which the maximum length WL of the internal weight member 20 occurs. In this example, the length direction is the toe-heel direction of the club head. The central portion of the length direction means a portion ranging 20% of the maximum length WL toward both sides in the length direction from the mid point of the maximum length WL in the length direction.

Design 3

On the basis of the above-described design 2, a securing part 50 securing the internal weight member 20 to the head main body 10 may be further provided between the through-hole 22 and the projecting part 19 as shown in FIG. 13.

It is preferable that the securing part 50 fills a possible gap between the through-hole 22 and the projecting part 19 to prevent their relative movement by the friction and/or mechanical engagement between them.

It is not essential, but preferable that the securing part 50 is formed from a metal material 52 welded to the tip end of the projecting part 19 like a weld bead.

For example, such securing part 50 is formed from a metal material 52 melted and penetrated into the gap and then hardened in a state filling the gap and fused with the metal material of the projecting part 19, namely, that of the club head main body 10 in this example.

Therefore, even if the securing part 50 is not fused with or welded to the internal weight member 20, as the space between the through-hole 22 and the projecting part 19 decreases or disappears, the adhesion between the securing part 50 and the internal weight member 20 is improved.

This effectively prevent vibrations of the internal weight member 20 relative to the head main body 10, namely, vibrations in perpendicular directions to the protruding direction of the projecting part 19.

In order that the securing part 50 can firmly and stably fix the internal weight member 20 by increasing its bonding strength to the projecting part 19, the tip end of the projecting part 19 in this example is provided with a tapered portion 19*a* so that an annular space (gap) increasing towards the outer surface of the club head is formed between the tapered portion 19*a* and the through-hole 22.

The melted metal material 52 filling the annular space is increased in the volume and the contact surface with the projecting part 19, therefore, the bonding strength and the strength itself are increased.

In this example, the metal material 52 is given as a separate material from the projecting part 19 and the internal weight member 20 and fused with the projecting part 19.

But, it may be also possible to use a melted portion of the projecting part 19 as the melted metal material 52.

In any case, the metal material 52 hardened around the projecting part 19 forms the securing part 50 capable of firmly and stably fixing the internal weight member 20.

The through-hole 22 of the weight member 20 has an inside opening 22*a* toward the inside of the club head and an outside opening 22*b* toward the outside of the club head, and the outside opening 22*b* preferably has a larger opening area than the inside opening 22*a*. More specifically, the through-hole 22 in this example comprises a tapered portion in which the area of the cross section of the through-hole 22 perpendicular to its protruding direction is gradually decreased from the outside opening 22*b* toward the inside opening 22*a*. This also gradually increases the space between the through-hole 22 and the projecting part 19 for forming the securing part 50, toward the outside of the club head. Such space helps the melted metal material 52 poured therein to penetrate deep into the space, for example, near to the root of the projecting part 19. Thus, the securing of the internal weight member 20 from the outer side of the club head by the metal material 52 is enhanced. As a result, movements of the internal weight member 20 in the protruding direction of the projecting part 19 can be mechanically effectively prevented even if the internal weight member 20 is not welded, and abnormal noise due to such movements can be completely prevented.

Figure 14:
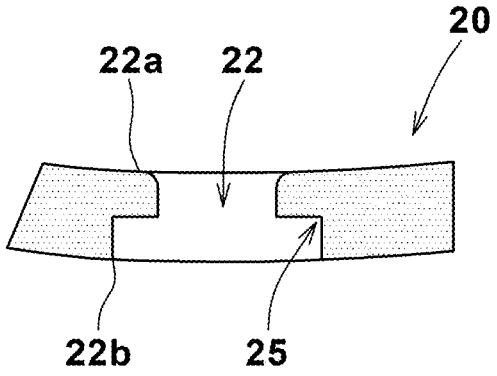
FIG. 14 is a cross sectional view of a modified example of the weight member taken at a position corresponding to line B-B of FIG. 2.

FIG. 14 shows another example of the through-hole 22 whose outside opening 22*b* is increased in the opening area. In this example, the through-hole 22 comprises an enlarged portion 25 on the outside opening 22*b* side in which the area of the cross section of the through-hole 22 is increased stepwise from its immediately inside portion.

It is preferable to employ the enlarged portion 25 in combination with the projecting part 19 with the tapered portion 19*a*. But, it is also possible to employ the enlarged portion 25 in combination with the projecting part 19 without the tapered portion 19*a*.

Aside from the above-described metal material 52, a wedge member press-fitted into the space between the projecting part 19 and the through-hole 22 such as a ring-shaped elastic body, a ring of an elastomer and a ring of a metal may be used as the securing part 50.

In either case, the securing part 50 is invisibly covered over with the fixing member 30, therefore the securing part 50 does not negatively affect the exterior appearance of the club head.

While detailed description has been made of a preferable embodiment and modifications of the present invention, the present invention can be embodied in various forms without being limited to the illustrated embodiment.

WORKING EXAMPLE

Based on the structure described with reference to FIGS. 1 to 11, a set of golf clubs having specifications shown in Table 1 was experimentally manufactured.

The golf club set in this example included nine golf clubs: 4 to 9 iron clubs (4i to 9i) and three kinds of wedges (Pw: pitching-wedge, AW: approach-wedge and SW: sand-wedge).

In this example, the weight-embedded golf clubs were 4 to 7 iron clubs (4i to 7i). The golf clubs other than the weight-embedded golf clubs were each not provided with the internal weight member, and made up of a head main body provided with a concave portion, and a fixing member fixed to the concave portion (thus, functioning as a weight member).

The golf clubs were measured for the distance GL of the center of gravity G of the head, the distance of the center of gravity of the head main body, the distance of the center of gravity of the internal weight member, and the distance of the center of gravity of the fixing member in the front views in the respective standard states as a distance in mm from the central axis of the clubshaft.

Figure 15:
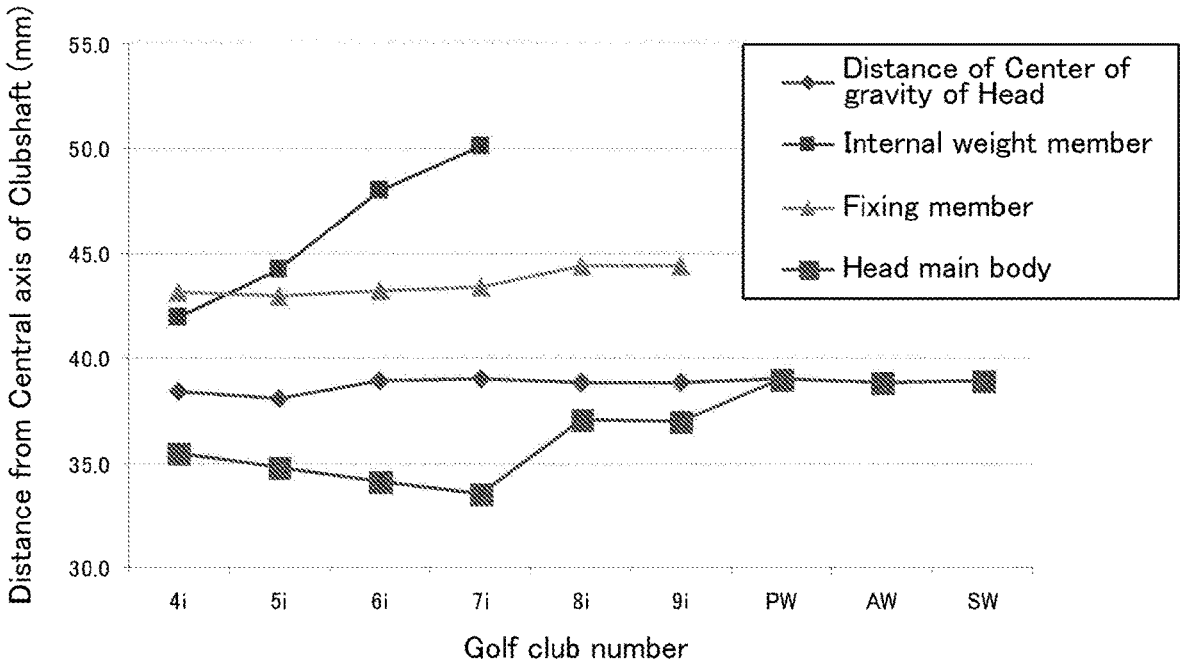
FIG. 15 is a graph showing the distances of the centers of gravity of golf club heads and the distances of the centers of gravity of the component parts.

The measured distances are shown in Table 1 and plotted in the graph show in FIG. 15.

TABLE 1

| | Distances from Clubshaft central axis (mm) | | | |
|---|---|---|---|---|
| club number | internal weight member | fixing member | head main body | club head |
| 4i | 42.0 | 43.2 | 35.5 | 38.4 |
| 5i | 44.2 | 43.0 | 34.8 | 38.1 |
| 6i | 48.0 | 43.2 | 34.1 | 38.9 |
| 7i | 50.1 | 43.4 | 33.5 | 39.0 |
| 8i | non | 44.4 | 37.1 | 38.9 |
| 9i | non | 44.4 | 37.0 | 38.8 |
| PW | non | non | 39.0 | 39.0 |
| AW | non | non | 38.8 | 38.8 |
| SW | non | non | 38.9 | 38.9 |

In the weight-embedded golf clubs included in the golf club set exemplified above, the distance of the center of gravity of the head main body (face plate plus face plate receiving part) from the central axis of the clubshaft became shorter as the loft angle became larger. That is, in the weight-embedded golf clubs, a golf club head having a larger loft angle had the center of gravity of the head main body positioned more on the heel side. This was mainly achieved by the different lengths of the hosels.

Meanwhile, the distance of the center of gravity of the internal weight member from the central axis of the clubshaft became larger as the loft angle became larger. That is, in the weight-embedded golf clubs, a golf club head having a larger loft angle had the center of gravity of the internal weight member positioned more on the toe side.

By employing such internal weight members, the distances GL of the centers of gravity G of all the golf club heads were able to fall in a range from 38.1 to 39.0 mm. This range can be considered to be substantially constant.

REFERENCE SIGNS LIST

1 golf club
2 club face
6 hosel
7 score lines
10 head main body
20 internal weight member
30 fixing member
Gw center of gravity
H golf club head
S clubshaft

The invention claimed is:

1. A golf club set including golf clubs having different loft angles and including weight-embedded golf clubs, each weight-embedded golf club comprising a club head composed of a head main body having a club face for hitting a ball, and an internal weight member disposed in the head main body, wherein the internal weight members of the weight-embedded golf clubs are arranged such that the loft angle is larger, the center of gravity of the internal weight member is positioned more on the toe side, and in the weight-embedded golf clubs, each golf club head comprises a fixing member fixed to the head main body so as to cover over the internal weight member.

2. The golf club set according to claim 1, wherein in the weight-embedded golf clubs, each of the head main bodies comprises a hosel, and a golf club having a larger loft angle has the hosel having a larger length.

3. The golf club set according to claim 2, wherein in the weight-embedded golf clubs, a golf club having a larger loft angle has the center of gravity of the head main body positioned more on the heel side.

4. The golf club set according to claim 2, wherein in the weight-embedded golf clubs, the difference between a minimum value and a maximum value of the distances of the centers of gravity of the golf club heads is 1.5 mm or less.

5. The golf club set according to claim 1, wherein the internal weight member is disposed in a sole portion of the club head.

6. The golf club set according to claim 1, wherein in the weight-embedded golf clubs, the fixing members have the substantially same contour shapes.

7. The golf club set according to claim 6, wherein the specific gravity of the fixing member is more than the specific gravity of the head main body, and less than the specific gravity of the internal weight member.

8. A golf club set including golf clubs having different loft angles and including weight-embedded golf clubs, each weight-embedded golf club comprising a club head composed of a head main body having a club face for hitting a ball, and an internal weight member disposed in the head main body, wherein the internal weight members of the weight-embedded golf clubs are arranged such that the loft angle is larger, the center of gravity of the internal weight member is positioned more on the toe side, and in the weight-embedded golf clubs, a golf club having a larger loft angle has the center of gravity of the head main body positioned more on the heel side.

9. The golf club set according to claim 8, wherein in the weight-embedded golf clubs, the difference between a minimum value and a maximum value of the distances of the centers of gravity of the golf club heads is 1.5 mm or less.

10. The golf club set according to claim 8, wherein in the weight-embedded golf clubs, each golf club head comprises a fixing member fixed to the head main body so as to cover over the internal weight member.

11. The golf club set according to claim 10, wherein in the weight-embedded golf clubs, the fixing members have the substantially same contour shapes.

12. A golf club set including golf clubs having different loft angles and including weight-embedded golf clubs, each weight-embedded golf club comprising a club head composed of a head main body having a club face for hitting a ball, and an internal weight member disposed in the head main body, wherein the internal weight members of the weight-embedded golf clubs are arranged such that the loft angle is larger, the center of gravity of the internal weight member is positioned more on the toe side, and in the weight-embedded golf clubs, the difference between a minimum value and a maximum value of the distances of the centers of gravity of the golf club heads is 1.5 mm or less.

13. The golf club set according to claim 12, wherein in the weight-embedded golf clubs, each golf club head comprises a fixing member fixed to the head main body so as to cover over the internal weight member.

14. The golf club set according to claim 13, wherein in the weight-embedded golf clubs, the fixing members have the substantially same contour shapes.

* * * * *